US006419101B1

(12) United States Patent
Hessel et al.

(10) Patent No.: US 6,419,101 B1
(45) Date of Patent: Jul. 16, 2002

(54) TEAR BAND CLOSURE

(75) Inventors: Brian Hessel, Rolling Meadows; Valentin Hierzer, Arlington Heights; Rick Gaiser, Spring Grove, all of IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/395,910

(22) Filed: Sep. 14, 1999

(51) Int. Cl.[7] ..... B65D 41/34; B65D 41/38

(52) U.S. Cl. ..... 215/253; 215/235; 215/252; 215/256; 222/541.5; 222/541.6

(58) Field of Search ..... 215/253, 254, 215/256, 258, 211, 235, 237, 244, 305, 317, 320, 321, 329, 341, 343–345, 901; 220/254, 255–259, 265, 266, 268, 276, 288, 810, 833–837, 839, 831.832; 222/107, 92, 541.5, 541.6, 541.9, 567, 568, 569

(56) References Cited

U.S. PATENT DOCUMENTS 4,236,653 A * 12/1980 Gach ..... 222/153.14 X
4,461,391 A 7/1984 Davis
4,479,586 A 10/1984 Csaszar
4,487,324 A * 12/1984 Ostrowsky ..... 215/253
4,778,071 A * 10/1988 Fillmore ..... 215/237
D304,424 S 11/1989 Dawson
5,104,008 A 4/1992 Crisci
5,139,163 A * 8/1992 Diaz ..... 220/258
5,143,234 A 9/1992 Lohrman et al.
5,335,802 A * 8/1994 Brach et al. ..... 215/253 X
5,405,031 A * 4/1995 Derksen ..... 215/237 X
5,597,082 A * 1/1997 Luch et al. ..... 215/256 X
5,769,253 A * 6/1998 Gross ..... 215/237
5,779,110 A * 7/1998 Brown et al. ..... 215/237 X
5,785,209 A * 7/1998 Guglielmini ..... 222/153.07
5,810,207 A * 9/1998 Hayashida ..... 222/153.07
5,875,942 A * 3/1999 Ohmi et al. ..... 222/153.07 X
5,927,527 A 7/1999 Mongtomery et al.
6,085,921 A * 7/2000 Brown ..... 215/252

* cited by examiner

*Primary Examiner*—Allan N. Shoap
*Assistant Examiner*—Niki M. Eloshway
(74) *Attorney, Agent, or Firm*—Woodcock Washburn LLP

(57) ABSTRACT

A closure is provided that includes a closure orifice that is at least as large as the container orifice, thereby enhancing drinking and pouring. A non-living hinge or a two-joint, living hinge enables easy opening and pivoting of a top cover completely away from a closure orifice to enable a user to drink directly from the closure. The top cover includes a plug that seals the closure orifice. A tear band encircles most of the top cover and secures the lid to the base, and provides tamper resistance. After detaching the tear band, the closure may be pivoted open about the hinge to its fully open position.

31 Claims, 11 Drawing Sheets

TEAR BAND CLOSURE

BACKGROUND

This invention relates to closures for containers, and more particularly to reusable, tamper evident, dispensing closures for containers of liquid or paste products.

Containers having removable, re-usable closures may be employed for retail packaging of virtually any flowable product. Numerous configurations and sizes are employed depending on the particular characteristics of the product, its intended use, and similar parameters. Products suitable for packaging in such containers include viscous liquids (for example, shampoo, conditioner, lotions, oils, and the like), low viscosity liquids (for example, beverages such as water, juices, carbonated sodas), and granular powders (for example, detergents, spices, and the like).

For many products, including viscous liquids, the size of the container orifice typically is determined according to the desired throughput of the orifice based on the product viscosity. For example, paste-like, high-viscosity dishwasher detergent may require a larger orifice to encourage flow therethrough than would a shampoo. Likewise, a low-viscosity oil, such as baby oil, which has a lower viscosity than shampoo, would require a smaller orifice than that for shampoo.

Liquid beverages typically are provided for retail sale and subsequent use in a plastic container having a removable, screw-type closure with a frangible tamper evident band formed at its bottom concentrically around the container neck, such as that disclosed in co-pending U.S. patent application Ser. No. 09/032,542, now U.S. Pat. No. 6,085,921 entitled, "Tamper Evident Band With Undercut," and co-pending U.S. patent application Ser. No. 09/224,962, now U.S. Pat. No. 6,253,939 entitled, "Tamper Evident Closure Having Improved Drainage," each of which are incorporated herein by reference in its entirety. After initial tearing of the tamper evident band and removal of the closure from the container, the closure may be reused by screwing the closure onto the threads on the container neck. Because the closure is fully removed before using, the pour opening is unencumbered by the closure, which enhances pouring or drinking from the container's opening.

Many containers, including many 16 ounce and two liter beverage containers, have a neck with a 28 mm finish, which has become a standard size in the beverage packaging industry. The internal diameter of the container neck of a 28 mm finish is often approximately 0.86 inches. Liquid beverages are sometimes packaged with containers having enlarged orifices (that is, larger than the 28 mm closure).

Some liquid beverage containers have a push-pull dispenser attached, the combination of which is sometimes termed a "sports bottle." A typical example of a push-pull dispenser is disclosed in U.S. Pat. No. 5,104,008, entitled, "Resealable Bottle Cap With Push-Pull Closure." Push-pull dispensers often include an upstanding pour spout or tube registering with an opening in the center of the cap and a smaller diameter plug positioned above the pour spout. A top cap is movably attached to the pour spout and has an opening in registration with the plug. The top cap is vertically movable to an upper position in which the opening is spaced apart from the plug to enable liquid dispensing and a lower position in which the opening is sealed by the plug. Push-pull dispensers typically have threads for screw connection with the neck of the container, and a tamper evident band as described above.

Although the push-pull dispenser may permit access to the liquid product without unscrewing the entire closure from the container neck, many users dislike the pouring characteristics of the push-pull dispenser, which often produces a narrow stream of fast moving liquid. Many users prefer the unencumbered access to the pour opening for drinking and pouring from the bottle neck to the smaller push-pull opening. Unscrewing a push-pull dispenser to uncover the container neck makes the push-pull dispenser superfluous. Further, conventional push-pull dispensers require a user to grasp the mouthpiece by hand. Such hand or finger contact of the mouthpiece promotes unsanitary and unhealthy conditions, especially in light of the frequent use and actuation of the push-pull mechanism. Even if the push-pull dispenser is used to dispense liquid into a container or cup for drinking, the top plug of the dispenser is exposed and likely to be subjected to dirt or other contaminants.

It is a goal of the present invention to provide a closure having good pour characteristics and a provision to indicate tampering, and that is easy to use.

SUMMARY OF THE INVENTION

A closure for a container for use with a flowable product is provided that comprises a closure body and a top cover. The closure body has a spout sidewall and a circumferential skirt downwardly depending from the sidewall. The sidewall defines an orifice therein for dispensing the product therethrough. The top cover, which removably covers the closure orifice, includes a circumferential base coupled to the closure body; a movable lid including a cover and a plug downwardly extending from the underside of the lid; a tear band removably coupled to the lid; and a hinge pivotally coupling the lid to the base.

The tear band and the hinge are disposed substantially around a perimeter of the cover. Preferably, except for a pair of slots that are disposed on each side of the hinge and that separate the hinge from the tear band, the tear band and the hinge circumscribe the perimeter of the lid. The tear band is upwardly inclined such that un upper, planar portion of the lid is disposed above the base to provide space for the plug to be insertable into and removable from the spout wall. The plug is removably insertable into the spout to seal the orifice, which isolates the product within the container. Preferably, the spout and the plug have a height (that is, along a centerline of the closure) and a fit that provides an airtight seal therebetween, even against positive pressure (that is, pressure greater than standard atmospheric pressure) contained within the container.

The closure has a tamper-resistant position in which the tear band couples the lid to the base to prevent actuation of the lid, a closed position in which the tear band is detached from the top cover and the plug is sealably disposed within the closure body orifice, and an open position in which the lid is spaced apart from the orifice via pivoting about the hinge to enable dispensing of the flowable (preferably liquid) product. The orifice has a diameter that is at least as large as a container neck orifice, preferably along the entire height of the spout wall, such that the diametral relationship between the closure orifice and the container neck orifice enhances pour characteristics of the closure by, for example, eliminating constrictions in the closure.

Further, especially with respect to a 28 mm closure, a user is familiar with the container neck orifice pouring and dispensing characteristics (that is, the rate of product flow over a range of inclination angles of the container, the angle at which the container orifice is choked, and like characteristics). Thus, providing the closure with an enlarged opening similar in size or larger than the container neck opening provides the user with predictable and familiar pouring and dispensing characteristics. Moreover, such a closure orifice provides a relatively large flow rate compared to sport bottle closures and similar closures that have an outlet constriction.

The hinge is configured such that the lid is pivotable away from the spout to render the spout freely accessible while the closure is in the open position. The lid may pivot more than 180 degrees, and preferably approximately 270 degrees, to be entirely disposed outside of an imaginary vertical geometric projection that projects from the closure orifice along a longitudinal centerline of the closure, as well entirely disposed below an uppermost portion of the spout. A user's mouth, therefore, has complete access to the spout to enable the user to drink directly from the closure.

In addition to the benefits of the pour opening, the closure has easy-opening characteristics. The closure enables removal of the lid to expose the orifice without unscrewing the entire closure from the container neck. Further, the opening and closing of the lid may be accomplished with little or no contact between the closure parts that contact the user's mouth and the user's hand or finger(s) during the opening and closing processes, which promotes cleanliness of the closure.

The hinge may be either a non-living hinge, or include a pair of living hinges disposed on opposing sides of a panel. A snap boss and a matching snap recess are disposed on the closure top cover to releasably secure the lid in the open position.

DETAILED DESCRIPTION OF A PREFERRED EMBODIMENT

Figure 1:
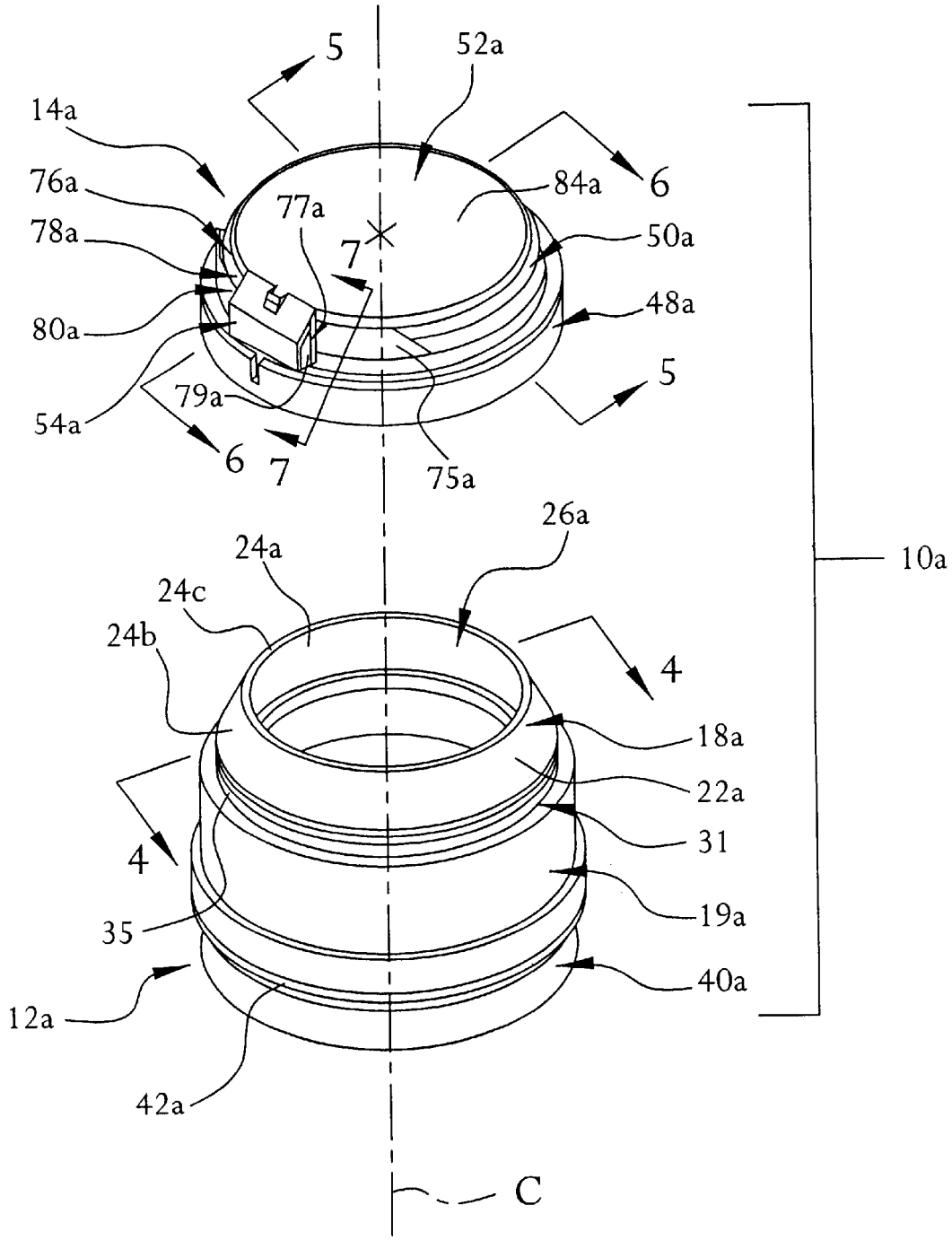
FIG. 1 is an exploded perspective view of an embodiment of the closure according to the present invention.
Figure 2:
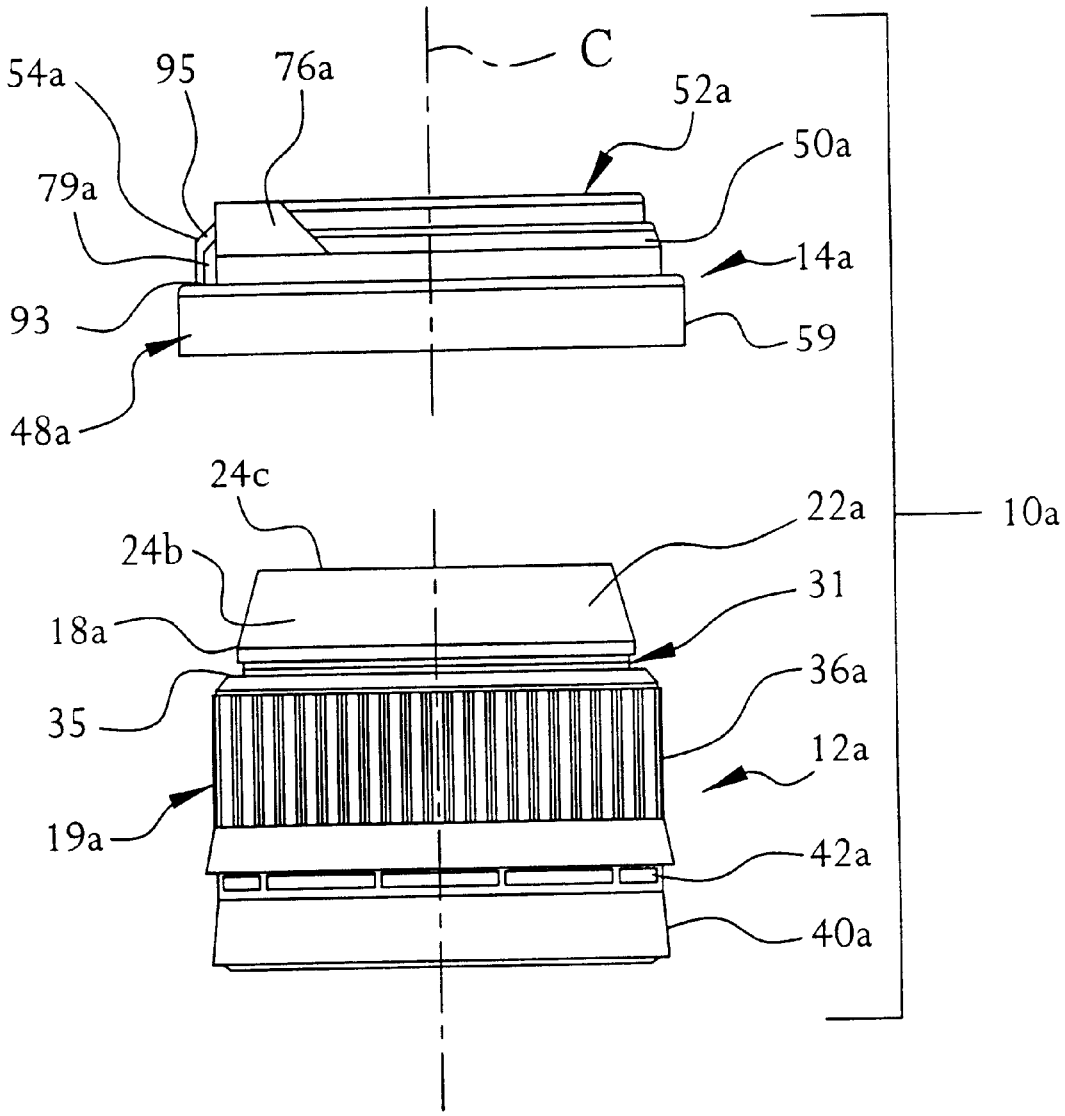
FIG. 2 is an exploded side view of the embodiment of FIG. 1.
Figure 3A:
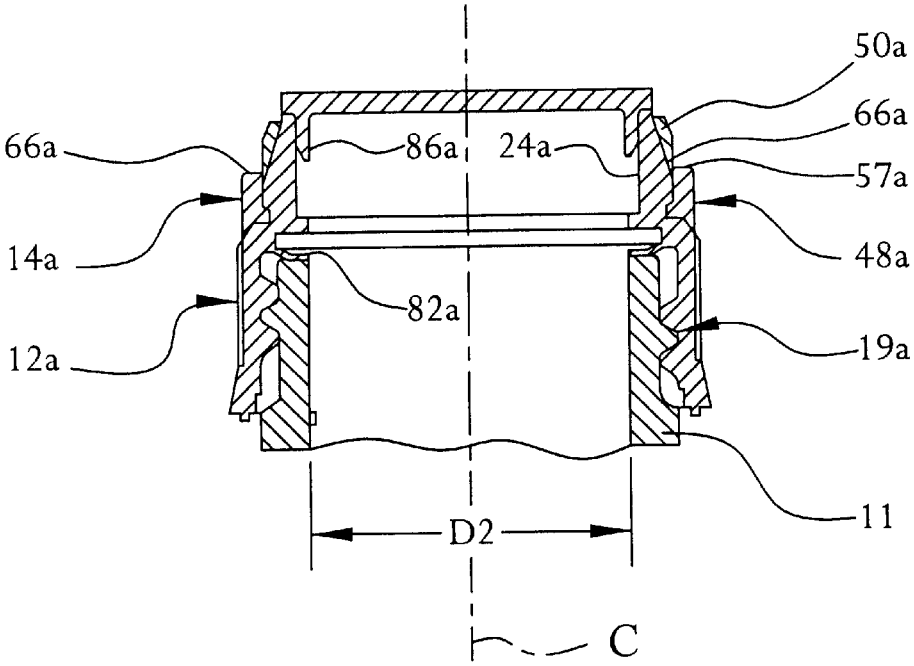
FIG. 3A is a cross sectional view of the closure and container combination in the tamper resistant position, taken through a portion that is spaced apart from the hinge and the tabs.
Figure 3C:
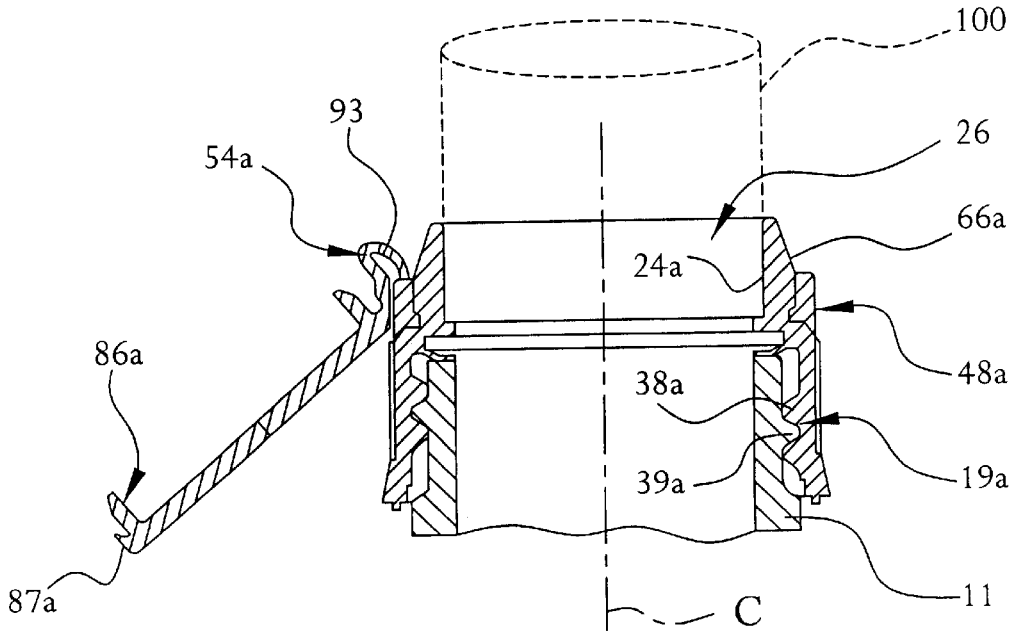
FIG. 3C is a cross sectional view of the closure and container combination taken through the hinge area with the closure in the open position.
Figure 3B:
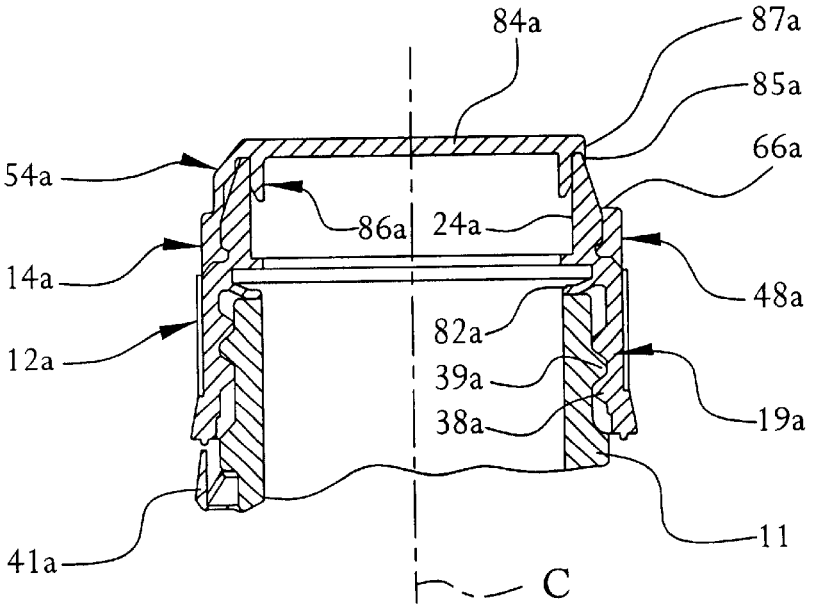
FIG. 3B is a cross sectional view of the closure and container combination taken through the hinge area with the closure in the closed position.

Referring to FIGS. 1 through 10 to illustrate a first embodiment of the present invention, a closure 10*a* is removably coupled to a container 11, as best shown in FIGS. 3A and 3B. Closure 10*a* defines a longitudinal axis C that is disposed at the centerline of the closure, which is co-linear with the longitudinal axis of the container orifice. As best shown in FIGS. 1, 2, and 3A, closure 10*a* includes a closure body 12*a* and a top cover 14*a,* which preferably are independently formed of injection molded or compression molded, conventional plastic.

Figure 4:
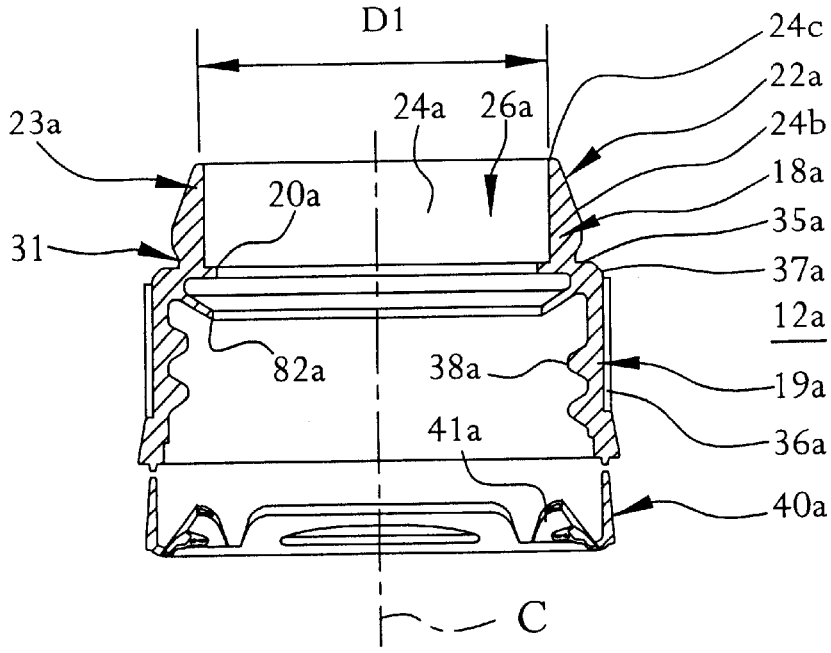
FIG. 4 is a cross sectional view of a body portion of the closure taken along line 4—4 of FIG. 1.

As best shown in FIG. 4, closure body 12*a* includes a spout 22*a* and a circular skirt 19*a* that preferably is integrally formed with spout 22*a* and depends downwardly therefrom. Spout 22*a* has an outer diameter that is smaller than an outer diameter of skirt 19*a.* Closure body 12*a* may also have an inwardly extending flange or ring 20*a* that extends concentrically inside of the innermost portion of spout 22*a.* Spout 22*a* is formed by a wall 23*a* that includes an inside surface 24*a,* an outside surface 24*b,* and a top rim 24*c* disposed around the top edge of wall 23*a.*

Wall 23*a* preferably is concentric with longitudinal centerline C to center orifice 26*a* in closure 10*a* and to align orifice 26*a* with the pour opening of container 11. Preferably, spout 22*a* (that is, orifice 26*a*) has an inside diameter D1 (as shown in FIG. 4) of approximately 0.906 inches. Orifice 26*a* may have diameter D1 that is consistent throughout closure 10*a* (that is, the walls forming orifice 26*a* are smooth, continuous, and cylindrical).

Alternatively, the diameter of orifice 26*a* may vary in diameter at different locations along its height, either because of tapering or protrusions or recesses, such as at ring 20*a*. It is preferred, however, that orifice 26*a* have a minimum diameter (that is, the inside diameter at the narrowest portion of spout 22*a*) that is similar to, equal to, or larger than that of the container neck inside diameter. Thus, the inner diameter of ring 20 and crabs claw seal 82*a,* which is explained below, preferably are approximately equal to or larger than the inner diameter of the pour opening in the neck of container 11.

Spout wall 23*a* extends upwardly from skirt 19*a,* although it may also extend downwardly therefrom according to the design parameters of the particular closure. Wall 23*a* has an outermost diameter that is less than an outer diameter of skirt 19*a.* Wall inside surface 24*a* is shown as smooth, although the present invention encompasses protrusions (such as steps, bosses, and the like) and other surfaces that cooperate with a top cover extension or plug 86*a,* which will be described below, especially to provide or augment sealing therebetween.

Wall outside surface 24*b* preferably is downwardly, outwardly tapered. Inside surface 24*a* is preferably cylindrical. Thus, spout 22*a* is upwardly tapered (that is, has a gradually decreasing outside diameter toward rim 24*c*). The present invention encompasses orifices having oval and other shapes that are not circular (not shown).

A circumferential undercut or recess 31 is formed on the outside surface 24*b* of spout wall 23*a* at a bottom portion thereof. Specifically, recess 31 is formed at the junction between spout wall 23*a* and a substantially horizontal shoulder 35*a* formed at the top of skirt 19*a*. Recess 31 preferably enables top cover 14*a* to securably attach to body 12*a* by cooperation with a circumferential tongue 63, as described below.

Skirt 19*a* is substantially annular and generally cylindrical, and includes vertically oriented ribs 36*a* (as best shown in FIG. 2, but omitted from FIG. 1 for clarity) disposed on its outer surface to enhance gripping by a user. Shoulder 35*a* extends substantially horizontally from spout wall 23*a* and yields to an annular bevel 37*a* that is disposed on an upper portion of skirt 19*a* above the ribs 36*a,* and above the substantially vertical, outside periphery of skirt 19*a*. At least one thread 38*a,* is disposed on its inner surface for mating to a corresponding thread on the container 11, as shown in FIG. 4.

Referring to FIG. 1, FIG. 2, and FIG. 4, skirt 19*a* may be coupled to a tamper evident band 40*a,* which is a band or ring that circumferentially engages and frangibly connects to the open, lower end of a lower portion of skirt 19*a*. The inner surface of tamper evident band 40*a* contains a flange 41*a,* which when placed on the container, hooks under a lug formed on the container neck. Tamper evident band 40*a* has sufficient resilience and elasticity so that flange 41*a* has a diameter slightly smaller than the diameter of the lug, yet can be placed or formed over the lug.

The frangible connection, designated by reference numeral 42*a* in the Figures, can withstand the outward deflection during application of closure 10*a* to the container 11, but yields under tension upon removal. Thus, when closure 10*a* is removed from the package, the force required to pull flange 41*a* over the lug is greater than the force required to break frangible connection 42*a*. FIG. 3B shows flange 41*a* in a detached position after the frangible connection has been ruptured.

Top cover 14*a* includes a base portion 48*a,* a tear band 50*a,* and a movable lid 52*a*. Lid 52*a* includes a hinge 54*a* that enables movement of lid 52*a* relative to base portion 48*a*. Preferably, top cover 14*a* is formed from a continuous piece of plastic by injection molding or compression molding, although the present invention encompasses forming top cover 14*a* in two or more pieces, forming all or portions of body 12*a* with top cover 14*a,* or forming portions of top cover 14*a* with body 12*a*.

Figure 10:
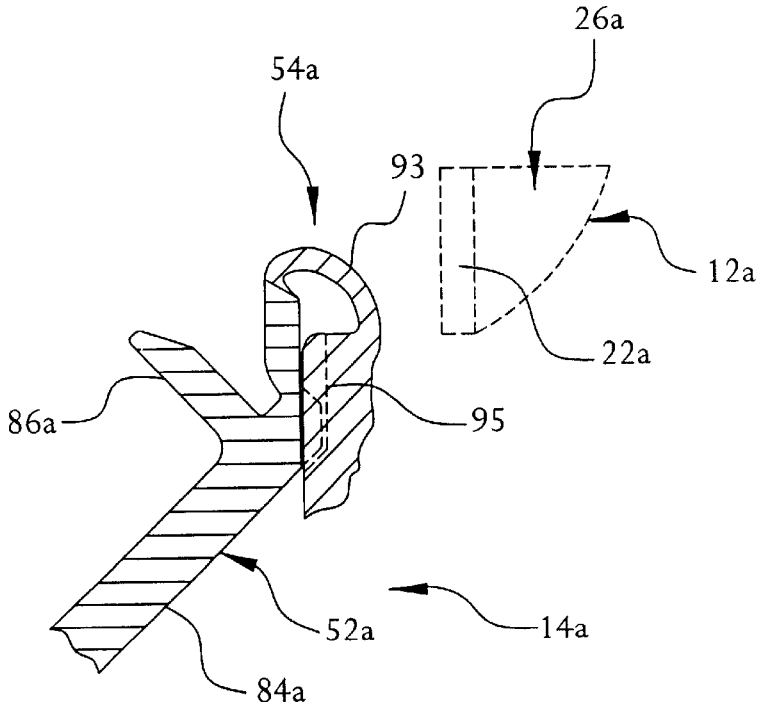
FIG. 10 is an enlarged cross sectional view of the portion of the closure shown in FIG. 9, corresponding to the closure in an open position.

Top cover 14*a* forms at least three states or positions: a tamper resistant position in which tear band 50*a,* is attached to top cover 14*a* (as shown in FIGS. 1, 2, and 3A), a closed position in which tear band 50*a,* is detached from top cover 14*a* and top cover 14*a* covers orifice 26*a* (as shown in FIG. 3B), and an open position in which top cover 14*a* is not covering orifice 26*a* and is substantially spaced apart therefrom (as shown in FIG. 3C and diagrammatically in FIG. 10). FIG. 3A, FIG. 3B, and FIG. 3C illustrate the tamper resistant position, the closed position, and the open position. FIG. 3A is a cross sectional view taken though closure 10*a* away from the hinge, and FIG. 3B and FIG. 3C are cross sectional views taken through closure 10*a* through the hinge area. The term "detach" and forms thereof used with respect to the tear band in the specification and appended claims may refer to fully disconnecting the tear band such that it may be discarded or to partially disconnecting the tear band such that the lid is free to move but the tear band remains attached to some portion of the closure, although the latter configuration is not shown.

Referring to FIG. 1 and FIG. 2, and the cross sectional views thereof, top cover 14*a* is disposed generally on top of body 12*a*. As best shown FIG. 3A and FIG. 3B, base portion 48*a* is coupled to closure body 12*a*. Base 48*a* is substantially annular and includes an outer face 59 and an inner face 61 that opposes outer face 59*a*. As shown in FIG. 5 through FIG. 10, base 48*a* has a generally rectangular cross section and has an inwardly protruding, circumferential tongue 63 and a downwardly protruding, annular tapered edge 65. Referring particularly to FIG. 5 through FIG. 9, base 48*a* forms a shoulder 57*a* on a top portion thereof.

Tongue 63 is disposed on a lower portion of base 48*a* and protrudes from inner face 61. Tongue 63 has a cross section that matches (that is, fits tightly into) recess 31 such that recess 31 receives tongue 63 to securely couple top cover 14*a* to closure body 12*a*. Tapered edge 65 protrudes downwardly from a bottom of base 48*a* such that its outer surface is flush or even with outer face 59. Tapered edge 65 is tapered or beveled to match (that is, fit tightly over) bevel 37 of closure body 12*a* to form a smooth transition between the outer surfaces of closure body 12*a* and top cover 14*a*.

Specifically, outer face 59 of top cover 14*a* is substantially vertical, and has approximately the same outer diameter as the outer diameter of an upper portion of skirt 19*a* such that the combination of body 12*a* and top cover 14*a* provide a smooth surface at the junction thereof. Because of the substantially tight fit between tongue 63 and recess 31 and between tapered edge 65 and outer face 59, top cover 14*a* preferably cannot be removed from closure body 12*a* without providing evidence of tampering, such as pry or gouge marks at the interface between top cover 14*a* and closure body 12*a*.

Referring again to FIG. 5 through FIG. 10, tear band 50*a* preferably is curved around the longitudinal axis C of the closure. Alternatively, the tear band may be offset (not shown) from centerline C to locate at least a portion of the lid at a predetermined, desired position relative to the hinge. Tear band 50*a* has a membrane-like outer frangible connection 72*a* and a membrane-like inner frangible connection 74*a* that have substantially matching profiles. Thus, tear band 50*a* is formed by connections 72*a* and 74*a* disposed on an inner and outer portion thereof. The body of tear band 50*a* extends inwardly and inclines obliquely upward from base 48*a*. Thus, tear band 50 may form a portion of a frustum. The term frustum, as used in the written description and appended claims, refers to a base portion of a cone.

Outer connection 72*a* is formed between an outer edge of tear band 50*a* and an inner rim 66*a* of base 48*a,* as best shown in FIG. 3A, FIG. 3B, and FIG. 3C. Inner rim 66*a* is formed on an inboard side of base shoulder 57*a*. Inner connection 74*a* is formed between an outer edge of tear band 50*a* and an outer rim 85*a* of lid 52*a,* which is described below.

Connections 72*a* and 74*a* are thin continuous membranes (relative to the thickness of the body of tear band 50*a*) formed by thin-walled portions of top cover 14*a* to enhance breaking when urged by a user. Top cover 14*a* may be formed of a material having properties that enable connections 72*a* and 74*a* to tear in response to peeling of tear band 50*a,* such as, for example, polyethylene.

Preferably, in the tamper resistant position, top cover 14*a* is continuous (that is, unbroken or without passages between its interior and exterior) over base 48*a,* connection 72*a,* tear band 50*a,* connection 74*a,* and lid 52*a,* except for a pair of slots 79*a* and 80*a* disposed near hinge 54*a* as shown in FIG. 1 and FIG. 2. Thus, tear band connections 72*a* and 74*a* discourage liquids and other contaminants from passing through top cover 14*a*. Alternatively, connections 72*a* and 74*a* may link tear band 50*a* to base 48*a* and lid 52*a* by structural bridges inter-spaced between slots (not shown in the Figures). For example, radially disposed structural members (not shown) may frangibly connect the tear band to the top cover. In configurations in which the connections do not prevent liquid or debris from the underside of the lid, the closure body may include drainage holes in the closure body or top cover base, or other provisions, to enable liquid to drain from under the top cover.

Figure 7:
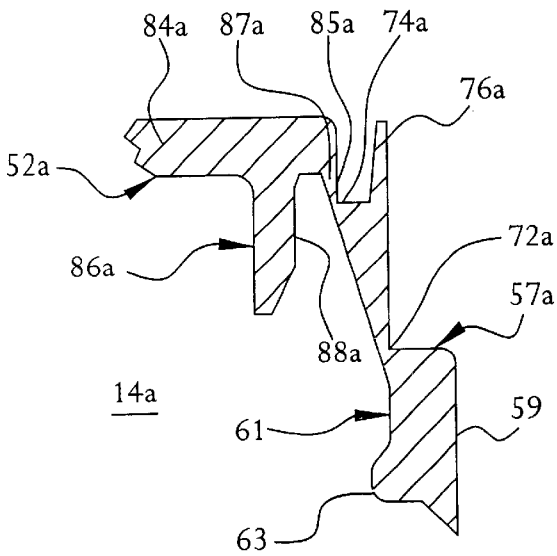
FIG. 7 is an enlarged cross sectional view of a portion of the closure taken along line 7—7 of FIG. 1.

As best shown in FIG. 1 and FIG. 2, tear band 50*a,* has a first end 77*a* and an opposing second end 78*a* that are disposed proximate slots 79*a* and 80*a,* respectively. A first end tab 75*a* is formed at the first end 77*a* of tear band 50*a,* and an opposing second end tab 76*a* is formed at the second end 78*a* of tear band 50*a*. Either of the tabs 75*a* or 76*a* may be gripped by a user to begin the process of detaching tear band 50*a* from base rim 66*a* and lid rim 85*a,* as best shown in FIG. 7. It is preferred that tabs 75*a* and 76*a* each protrude above other, adjacent portions of the closure 10, as shown in FIG. 7, to enhance the ease of gripping by a user.

Specifically, a user may grip either tab 75*a* or 76*a* and initially pull substantially radially outward from closure 10*a* to detach tear band 50*a* at connections 72*a* and 74*a* proximate the tab. Upon initial detachment of the tear band 50*a* from base rim 66*a* and lid rim 85*a* at the end of the tear band 50*a,* the tear band may be progressively detached counter-clockwise (gripping tab 75*a*) or clockwise (gripping tab 76*a*) until tear band 50*a* is fully detached from the remainder of closure 10*a*. The tear band 50*a* may then be discarded.

The embodiment of the tear band is described herein for illustrative purposes, although the present invention is not limited thereto. Rather, the present invention encompasses numerous configurations and geometries of the tab and tear band, as will be understood by persons familiar with plastic closure technology or with technology relating to detachable, plastic members such as tear bands.

Lid 52*a* includes the hinge 54*a,* a snap 56*a,* a cover 84*a,* and a plug 86*a*. Cover 84*a* is a substantially planar, circular, disk-like member, a top side of which is exposed while closure 10*a* is in the tamper resistant position and the closed position. Cover 84*a* has a center that is coincident with centerline C, thereby centering lid 52*a* relative to orifice 26*a* and container 11. As shown in the Figures, especially FIG. 7 and FIG. 8, a skirt 87*a* extends downward from the periphery of cover 82*a* and is tapered to enhance contact with the tapered, outside wall surface 24*b* while the closure is in the tamper resistant position or the closed position. Rim 85*a* is formed on the lowermost tip of skirt 87*a*.

Cover 84*a* is coupled to an upper portion of hinge 54*a* at a peripheral edge thereof. The rim of cover 84*a* may lack a skirt where it yields to hinge 54*a,* or the skirt may be formed to accommodate the hinge. For example, as best shown in FIG. 9, the skirt 87*a* may extended radially and downwardly to smoothly yield to an inclined panel 95 of the hinge, described below, and have an inboard surface that mates with or contacts the tapered surface 24*b* of the spout wall 23*a*.

Plug 86*a* depends downwardly from the underside of cover 84*a*. Plug 86*a* preferably is cylindrical such that plug 86*a* extends substantially perpendicular from the underside of cover 84*a*. It is preferred that plug 86*a* is sealably insertable into the orifice 26*a*. Although the Figures show a circular plug, the present invention encompasses oval and other non-circular orifice shapes. It is preferred, however, that the plug and the orifice have matching profiles to facilitate sealing therebetween.

Plug 86*a* preferably has a tapered portion disposed around at the end of its cylindrical body portion at its lower, outer edge to enhance ease of insertion into and removal from spout wall 23*a*. Thus, the plug should have a centerline line that is co-linear with that of the orifice, and plug 86*a* preferably has a centerline axis that is co-linear with centerline C. The present invention encompasses, however, the plug being offset or eccentric with the cover (although this configuration is not shown in the Figures) to facilitate removing and inserting the plug into the orifice.

Figure 8:
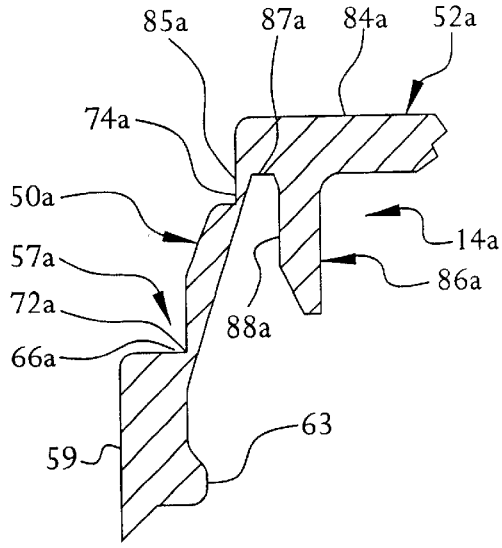
FIG. 8 is an enlarged cross sectional view of a portion of the closure indicated in FIG. 5 as area 8.
Figure 6:
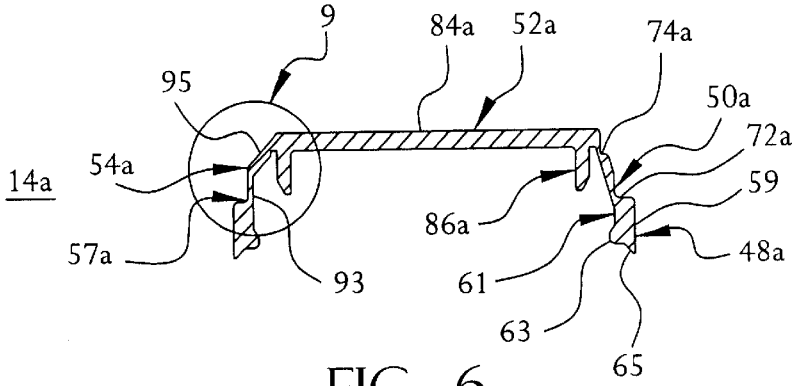
FIG. 6 is another cross sectional view of the top cover portion of the closure taken through the hinge area away from the snap through line 6—6 of FIG. 1.
Figure 5:
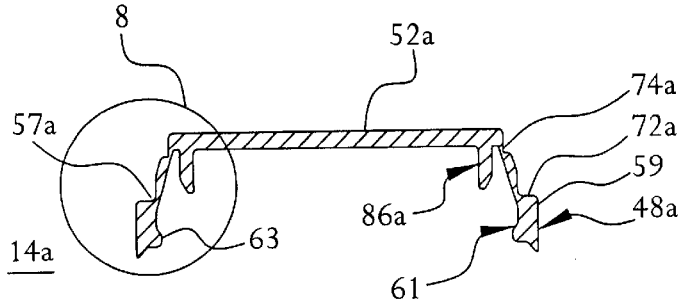
FIG. 5 is a cross sectional view of a top cover portion of the closure taken along line 5—5 of FIG. 1.
Figure 9:
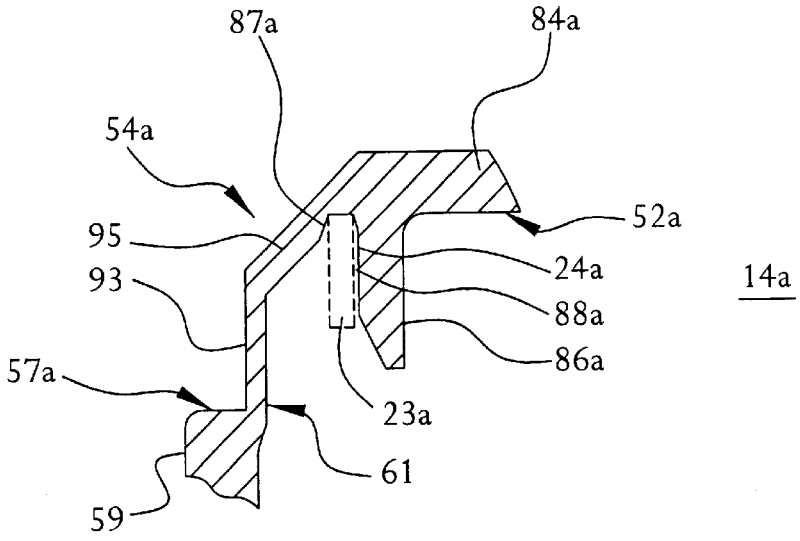
FIG. 9 is an enlarged cross sectional view of a portion of the closure indicated in FIG. 6 as area 9, corresponding to the closure in a closed position.

An outer circumferential surface of plug 86*a* forms a sealing surface 88*a,* as shown in FIG. 7, FIG. 8, and FIG. 9. Sealing surface 88*a* preferably has an outer diameter and profile that matches the inner diameter and profile of spout wall 23*a* inner surface 24*a* such that a seal is formed therebetween upon insertion of plug 86*a* into orifice 26*a*. The contact between surface 24*a* and 88*a* is shown in FIG. 9, which shows the spout in phantom.

Sealing surface 88*a* has an outer diameter that is smaller than the outer diameter of cover 84*a* such that plug 86*a* is disposed concentrically within and spaced apart from cover skirt 87*a*. Thus, sealing surface 88*a* and the inboard surface of cover skirt 87*a* form a substantially V-shaped groove (in cross section) into which spout wall 23*a* may be removably disposed while closure 10*a* is in the tamper resistant position and the closed position.

Further, plug 86*a* and/or spout wall 23*a* may include an annular bead (like that described with respect to bead 106 and recess 108, shown in FIG. 12, of the second embodiment below) to enhance sealing therebetween and to provide an audible indication that the plug is fully seated into the orifice, as will be understood by persons familiar with plastic closure technology or re-usable closure technology in light of the present disclosure.

Hinge 54*a* is disposed between tear band first tab 75*a* and second tab 76*a,* and, separated therefrom by slots 79*a* and 80*a,* respectively. Preferably, tear band 50*a* circumscribes the majority of the circumference of cover 84*a,* and hinge 54*a* and slots 79*a* and 80*a* circumscribe the remaining circumference of cover 84*a*. Hinge 54*a* includes a non-living hinge portion 93 and an inclined panel 95. Panel 95 has a lower edge that is coupled to an upper edge of non-living hinge 93 and an upper edge that is coupled to the outer periphery of cover 84*a*. As described above, skirt 87*a* yields to panel 95. Panel 95 and non-living hinge 93 are configured to form an oblique angle greater than 90 degrees and less than 180 degrees therebetween, such as, for example approximately 135 degrees therebetween.

Non-living hinge 93 has a lower edge that is coupled to an inboard portion of shoulder 57*a* of base 48*a,* and extends substantially vertically upward therefrom while closure 10*a* is in the tamper resistant position and the closed position. As shown in FIG. 3C and in FIG. 10, non-living hinge 93 is flexible over its entire height (that is, substantially along the vertical axis as shown in FIG. 3B) to enable lid 52*a* to move from the closed position to the open position.

Hinge 54*a* is configured such that lid 14*a* pivots past 90 degrees. Thus, non-living hinge 93 enables cover 84*a* and plug 86*a* to pivot from the top of base 48*a* such that it may be disposed entirely outside of a vertical, geometric projection 100 of orifice 26*a* while closure 10*a* is in the fully open position. As shown in FIG. 3C, vertical, geometric projection 100 is an imaginary, cylindrical extension of orifice 26*a* or spout wall inside surface 24*a*. Lid 52*a* being disposed outside of geometric projection 100 in the open position enables a user to drink directly from spout 22*a*. Further, such a position enhances the pouring characteristics of the closure by providing good visibility of the pour opening and preventing the movable lid 52*a* from interfering with the flowing product during pouring.

A snap 56*a* is formed on top cover 14*a* to releasably secure top cover 14*a* while it is in the fully open position. Snap 56*a* includes a boss 102*a* formed in a first portion of closure 10*a* and a mating recess 104*a* for receiving the boss 102*a* formed in a second portion of closure 10*a*. The first and second portions may be brought into mutual contact or close proximity in response to opening the closure 10*a* to its fully open position. Boss 102*a* preferably is disposed on one of base 48*a* and either cover 84*a* or hinge panel 95, and mating recess 104*a* is disposed in the other of base 48*a* and either cover 84*a* or hinge panel 95.

Preferably, as shown in FIG. 1 and FIG. 10, boss 102*a* extends radially outwardly from hinge panel 95 proximate the periphery of cover 84*a*. Snap recess 104*a* is formed on base 48*a* directly below boss 102*a*. Boss 102*a* and snap recess 104*a* are preferably both rectangular. Preferably, both snap boss 102*a* and the snap recess 104*a* are formed on top cover 14 for injection molding and alignment considerations. Referring particularly to FIG. 10, fully flexing non-living hinge 93 (that is, pivoting lid 52*a* to the fully open position) enables boss 102*a* to make contact with recess 104*a*. Boss 102*a* is, thus, removably inserted or snapped into recess 104*a* to releasably secure lid 52*a* to base 48*a*. The closure is, thus, in position for pouring or drinking directly therefrom, during which process lid 52*a* remains releasably secured to base 48*a* via the snap.

As shown in FIG. 4, lid 52*a* also includes a conventional crab claw seal 82*a* that extends inwardly and downwardly from the underside of cover 84*a*. As shown in FIG. 3A through FIG. 3C, seal 82*a* deflects or otherwise forms a seal between its lip portion and the top rim of container neck 11 to seal closure 10*a* while closure 10*a* is fully screwed onto container 11. Seal 82*a* may deflect more than shown in FIG. 3A, and may deflect until seal 82*a* contacts the underside of ring 20*a*. The crab claw seal is provided to illustrate a type of seal that may be employed, and the present invention encompasses any type seal between closure 10*a* and container 11.

Closure 10*a* may be coupled to container 11 via thread closure 38*a,* which engages a matching thread 39*a* on the outside of the container neck. The seal provided by closure 10*a* of container 11 while fully threaded together is airtight in both the tamper resistant position and the closed position. The airtight seal may be provided by the airtight fit between sealing surface 88*a* of plug 86 and spout 22*a,* the contact between the lip of crabs claw seal 82*a* with the top rim of the container neck, or a combination thereof.

According to an aspect of the present invention, orifice 26*a* has diameter D1 (shown in FIG. 4) that is approximately equal to, or larger than, an inside diameter D2 of the container neck (shown in FIG. 3A). Preferably, diameter D1 is 0.906 inches while diameter D2 is a standard 0.86 inches for a 28 mm closure. The present invention encompasses a closure having an orifice that is substantially equal in diameter to the container neck (that is, diameter D1 may be 0.86 inches for use with a 28 mm finish having diameter D2 of 0.86 inches).

Further, the present invention encompasses a closure having a diameter D1 that is smaller than container diameter D2, but having other aspects of the present invention. In embodiments in which diameter D1 is smaller than diameter D2, it is preferred that orifice 26*a* have a cross sectional area that is at least 60 percent of the cross sectional area of the container neck opening, more preferably 75 percent, more preferably 82 percent, and even more preferably 90 percent thereof.

Such a relatively large closure orifice diameter D1 compared with the container neck orifice diameter D2, in contrast (for example) to a push-pull sports bottle mechanism, enhances the ease at which a user may drink directly from the closure. For example, when employed with a standard 28 mm container, closure 10*a* provides access by a user's mouth to the full area of the container's orifice 26*a*. Specifically, lid 52*a* is enabled to pivot such that movable lid 84*a,* plug 86*a,* and hinge 54*a* are spaced apart from orifice 26*a* and from the upper portions of closure 10*a* to enable a user's mouth to directly access orifice 26*a* by enabling the user's mouth or lips to encircle or engage spout 22*a* and/or base 48*a*.

Thus, closure 10*a* provides a combination of ease of opening (that is, especially after initially removing tear band 50*a,* the lid 52*a* may be readily opened by the user without fully unscrewing the closure from the container neck), direct drinking capability upon such easy opening, and tamper resistance or evidence. Further, the user is familiar with the full size orifice of the 28 mm finish closure, and generally has prior experience with drinking and pouring from the full size orifice. Thus, closure 10*a* also provides predictable liquid pouring characteristics within the experience of most users. The ease and familiarity of pouring characteristics is also beneficial for viscous liquids (such as shampoo, conditioner, lotions, oils, food gels, and the like) and flowable powders or granules.

Referring to FIG. 1 through FIG. 10 to illustrate the function and operation of the present embodiment, and particularly to FIG. 3A, FIG. 3B, and FIG. 3C, closure 10*a* is intended to be shipped, stored, and provided in the tamper-resistant position shown in FIG. 3A. Thus, tear band 50*a* and tamper evident band 40*a* are intact and attached to provide tamper resistance or tamper evidence until closure 10*a* is ready for initial use by a user. Plug 86*a* is fully inserted into orifice 26*a* such that spout inner surface 24*a* contacts the outer periphery of plug 86*a* at sealing surface 88*a,* the tapered portion of spout outer surface 24*b* contacts the tapered or inclined portion of cover skirt 87*a,* and spout upper rim 24*c* may contact the underside of the V-shaped groove formed between plug 86*a* and cover skirt 87*a*. Any of the above contacting surfaces or members may form or augment the seal between container 11 and closure 10*a,* preferably in cooperation with crabs claw seal 82*a*. The membranes of connections 72*a* and 74*a* are intact, and therefore inhibit liquid or solid contaminants from reaching the underside of top cover 14*a*.

To change closure 10*a* from the tamper resistant position to the closed position (that is, to begin the opening process), a user may grasp tear band 50*a* at either tab 75*a* or tab 76*a*. Tab 75*a* or tab 76*a* (depending on which tab is grasped) is pulled radially outward and/or upward to detach tear band connections 72*a* and 74*a* around the circumference of cover 84*a*. Tear band 50*a* is detached by pulling until band 50*a* fully detaches from base rim 66*a* and lid rim 85*a*. A user may discard tear band 50*a* upon fully detaching band 50*a* from base 48*a* and lid 52*a*.

Upon fully detaching tear band 50*a,* closure 10*a* is in the closed position, as shown in FIG. 3B. The lack of tear band 50*a* indicates that the closure had previously been opened. To move closure 10*a* from the closed position to the fully open position, the user may urge upward against cover 84*a* at the periphery of cover skirt 87*a* approximately opposite hinge 54*a*. Such upward urging may be, for example, by a user's thumb while the remainder of the user's hand grasps the container neck and/or closure. Because the user may open the closure by touching only the rim of cover 84*a,* rather than by touching portions of the spout (or by lightly or incidentally touching only a small portion of the spout), spout 22*a* does not become contaminated by dirt or other unsanitary conditions from a user's hands or fingers, thereby promoting cleanliness of the spout and other portions likely to contact the user's mouth upon directly drinking therefrom. Further, the base 48*a* and lid 52*a* partially protect spout 22*a* from contamination by contact, especially while closure 10*a* is in the closed position.

In response to the upward urging, plug 86*a* slides out from spout wall 23*a* such that plug sealing surface 88*a* slides relative to spout inner surface 24*a*. As top cover 14*a* moves relative to base 48*a,* non-living hinge 93 flexes to enable lid 52*a* to move from the closed position toward the fully open position.

After further movement of lid 52*a* away from orifice 26*a,* hinge 54*a* is fully, flexibly pivoted from the closed position to the fully open position as shown in FIG. 3C. Thus, hinge panel 95 is disposed substantially in a vertical position such that snap boss 102*a* is snapped into snap recess 104*a* to releasably hold lid 52*a*. Thus, in the fully open position, panel 95 lies outside of the outer periphery of base 48*a* and/or skirt 19*a*.

Because hinge 54*a* includes non-living hinge 93, all portions of lid 54*a,* including cover 84*a,* plug 86*a,* and (preferably) hinge 54*a,* are disposed outside of and spaced apart from orifice 26*a*. Specifically, all portions of lid 54*a* are spaced apart from spout rim 24*c* and do not inhibit access to spout 22 such that all portions of lid 54*a* are spaced apart from imaginary geometric projection 100, thereby enabling access to spout 22*a* by a user's mouth.

Closure 10*a* may be moved from the open position toward the closed position by urging lid 52*a* toward the closed position until snap boss 102*a* is freed or unsnaps from snap recess 104*a*. Lid 52*a* may be further manually moved toward the closed position about hinge 54*a* until plug 86*a* inserts and is fully seated into orifice 26*a*. Plug sealing surface 88*a* may form a seal with spout inside surface 24*a* (and other surfaces may make mutual contact, as described above) such that the closure 10*a* seals orifice 26*a* to reposition closure 10*a* in the closed position. Thus, closure 10*a* enables re-use of the combination of container 11 and closure 10*a*.

Referring to FIGS. 11 through 17 to illustrate a second embodiment of the present invention, reference numerals bearing a "b" designation are similar or analogous to like reference numerals bearing an "a" designation in FIGS. 1 through 10. Persons familiar with closure technology or plastic manufacturing and design principles will understand that many of the features shown in the second embodiment may be interchanged with features shown in the first embodiment, according to conventional design principles in light of the present disclosure.

According to a second embodiment of the invention, a closure 10*b* is removably coupled to a container 11. Closure 10*b* includes a closure body 12*b* and a top cover14*b,* which preferably are independently formed of injection molded or compression molded conventional plastic. Closure 10*b* defines a longitudinal axis C that is disposed at the centerline of the closure, which is co-linear with the longitudinal axis of the container orifice.

Figure 11:
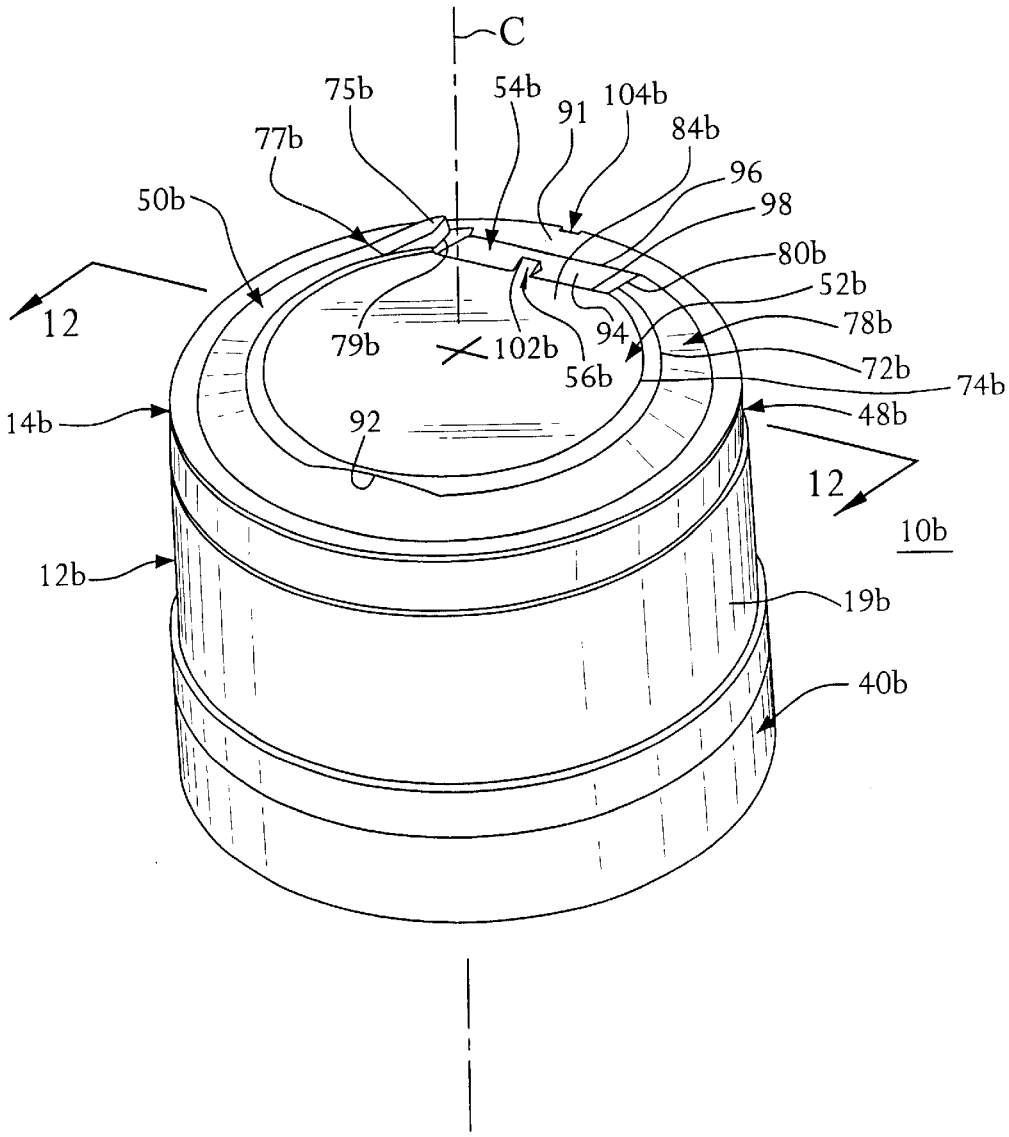
FIG. 11 is a perspective view of a closure according to a second embodiment of the present invention shown in the tamper resistant position.
Figure 12:
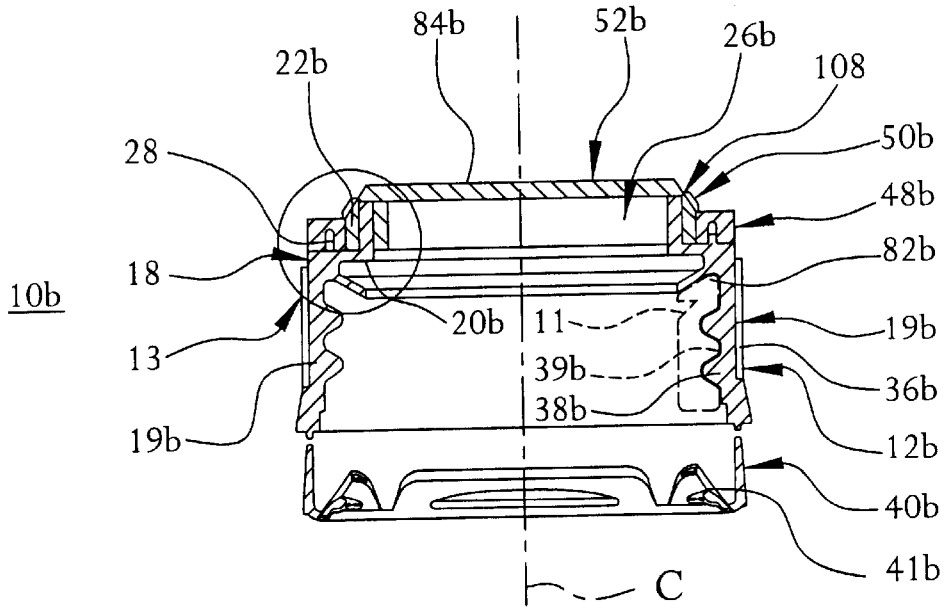
FIG. 12 is a cross sectional view of the closure of the second embodiment taken along lines 12—12 of FIG. 11.
Figure 13:
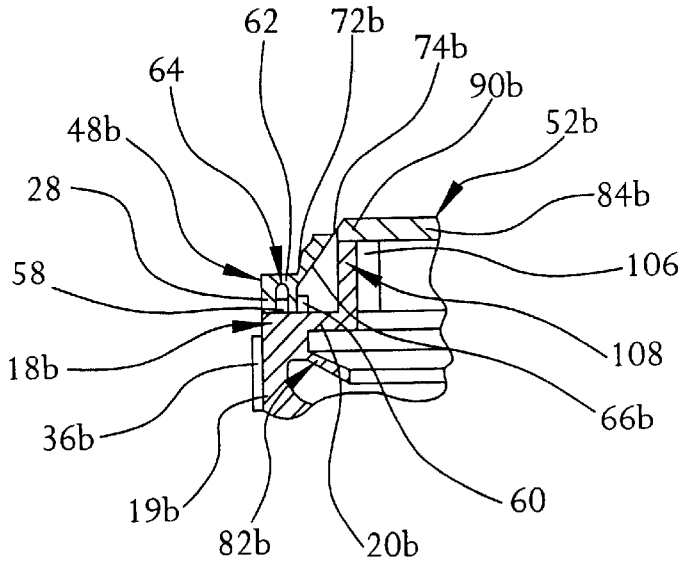
FIG. 13 is an enlarged cross sectional view of a portion of the closure indicated in FIG. 12 as area 13.
Figure 14:
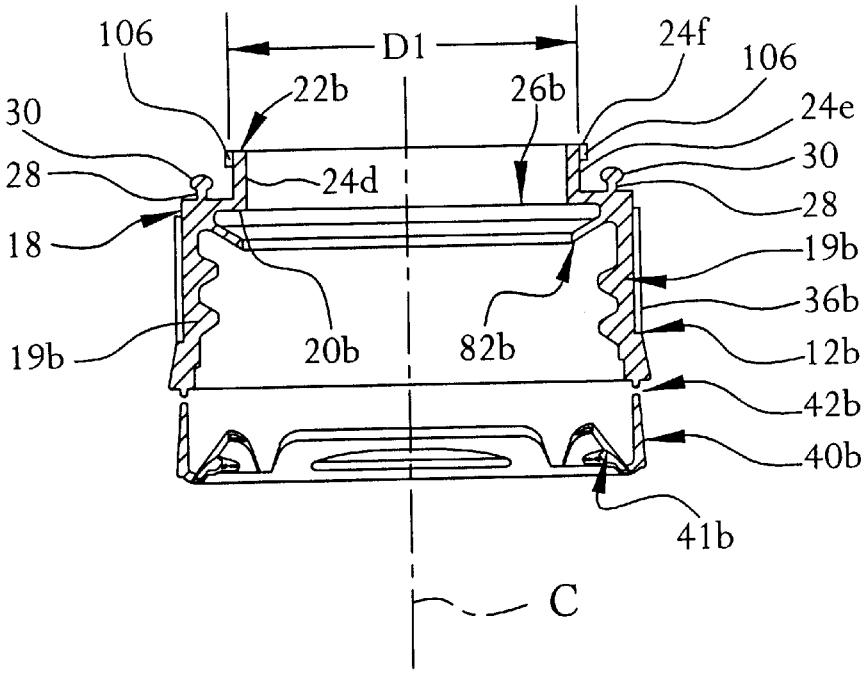
FIG. 14 is a cross sectional view of a portion of the closure shown in FIG. 11, with the top cover removed for clarity.
Figure 16:
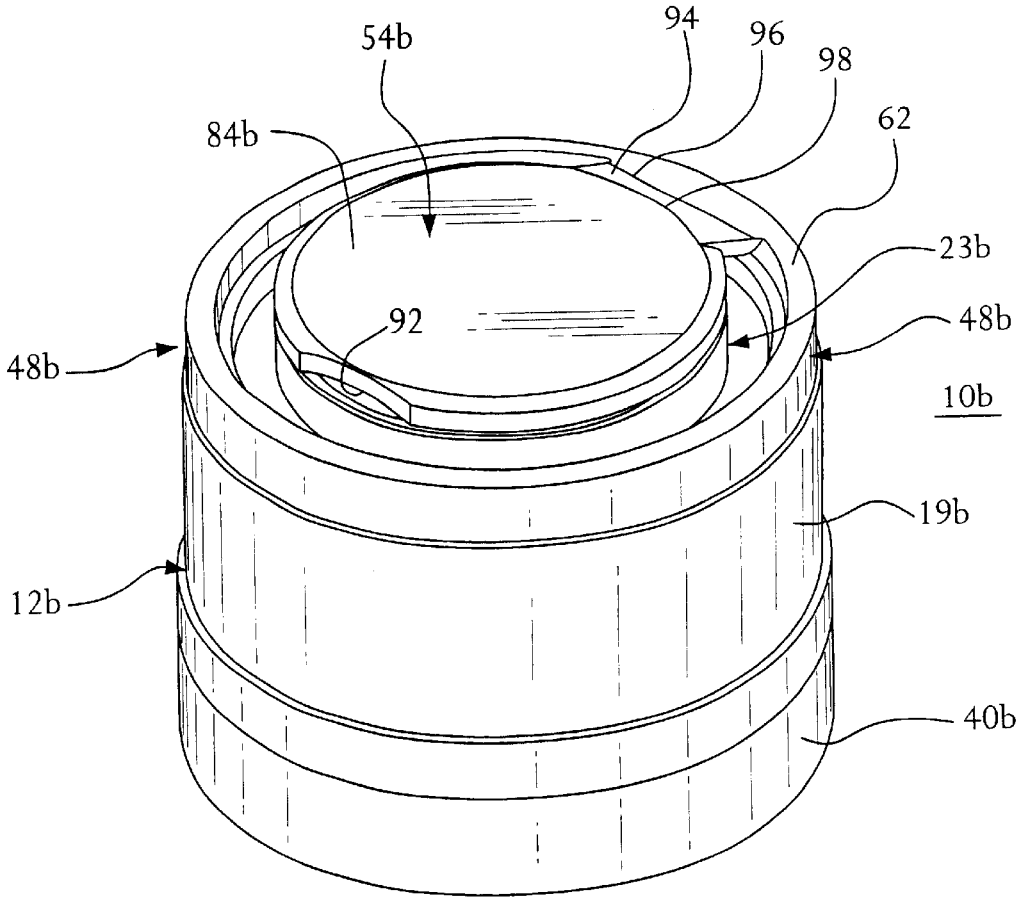
FIG. 16 is a perspective view of the closure shown in FIG. 11 in the closed position with the tear band detached.
Figure 17:
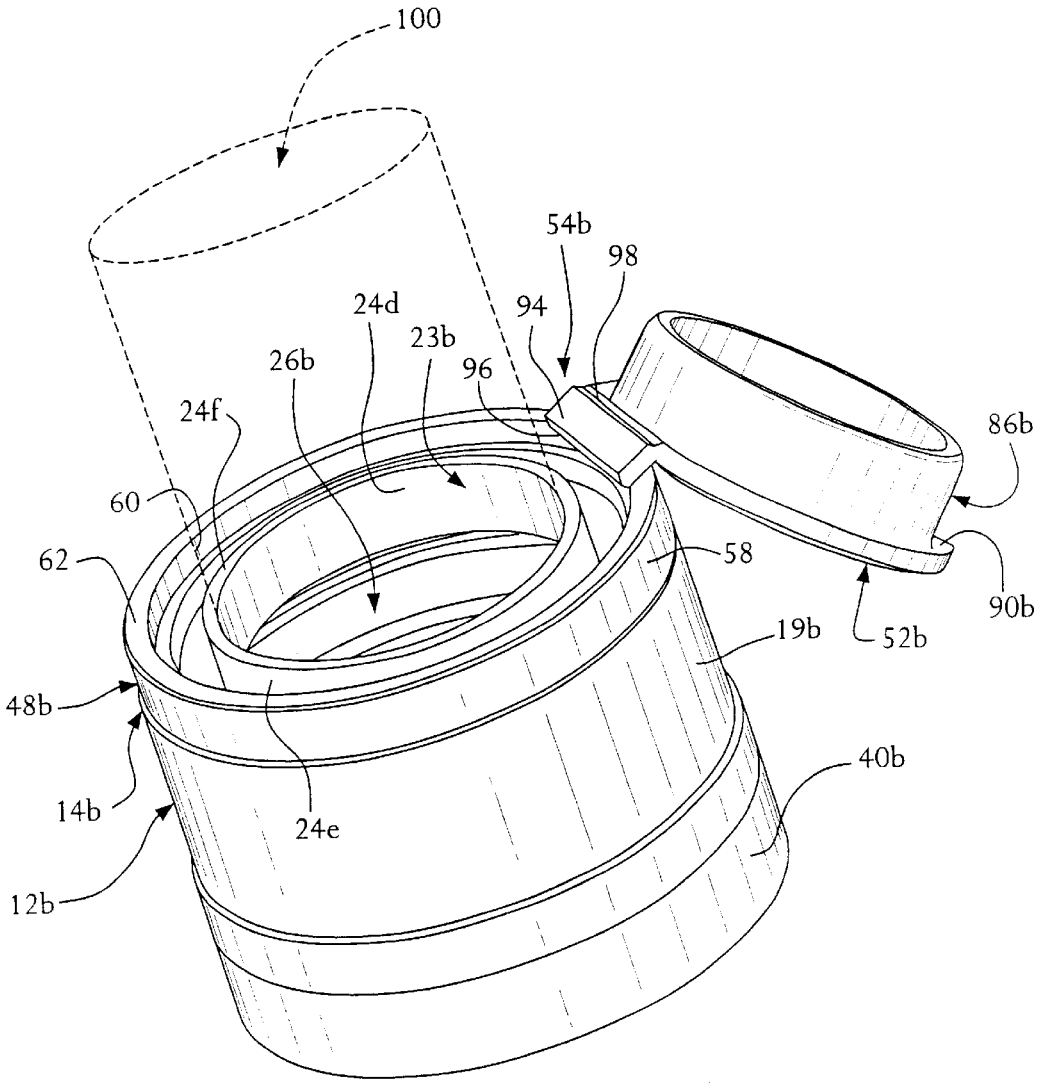
FIG. 17 is a perspective view of the closure shown in FIG. 11 in the open position.

Body 12*b* includes a top member 18 and a circular skirt 19*b* that preferably is integrally formed with top member 18 and depends downwardly therefrom, as best shown in FIG. 12, FIG. 13, and FIG. 14. Top member 18 includes an inwardly extending top member flange 20*b,* a spout 22*b,* an orifice 26*b* (as also shown in FIG. 17), and an upwardly extending ring 28. Preferably, flange 20*b* is disk-like or annular, and substantially horizontal. Spout 22*b* may be disposed at the innermost portion of flange 20*b* and extend substantially vertically upwardly therefrom to form a cylinder, as shown in the FIG. 12 and FIG. 17. The present invention also encompasses a frustum shape to form a cone (not shown in FIGS. 11 through 17). Such a conical shape may be oriented either upward or downward.

As best shown in FIG. 14 and FIG. 17, spout 22*b* is formed by a spout wall 23*b,* which has an inside surface 24*d,* an outside surface 24*e,* and a top rim 24*f* disposed around the top edge of wall 23*b*. Preferably, wall 23*b* extends upwardly from top member flange 20*b,* although it may also extend downwardly therefrom, or both, according to the design parameters of the particular closure. The present invention encompasses orifices having oval and other shapes (not shown) that are not circular.

Wall 23*b* preferably is concentric with longitudinal centerline C to center orifice 26*b* in closure 10*b* and to align orifice 26*b* with the pour opening of container 11, which is partially shown in phantom in FIG. 12. Alternatively, spout 22*a* may have a thickness that varies along it height similar to that shown with respect to the first embodiment. In a preferred embodiment, spout 22*b* (that is, orifice 26*b*) has an inside diameter D1 of approximately 0.906 inches.

Ring 28 extends substantially vertically upwardly from top member flange 20*b,* and preferably is concentric with and spaced apart from wall 23*b*. Ring 28 is also concentric with and spaced apart from the outer perimeter of skirt 19*b*. Ring 28 extends substantially perpendicular to flange 20*b,* and has an attachment feature, such as a bead 30, formed at its top edge. Bead 30 may have a substantially circular cross section (as shown in the Figures), a rounded top with flat undersides (not shown), or other shapes that enhance assembly and discourage disassembly of ring 28 with a receiving recess 64, which is explained below. Ring 28 and bead 30 are substantially continuous around the circumference of top member 18.

Skirt 19*b* is substantially annular and generally cylindrical, and includes vertically oriented ribs 36*b* disposed on its outer surface to enhance gripping by a user. Ribs 36*b* are shown in FIG. 12 and FIG. 14, and omitted from FIG. 11, FIG. 16, and FIG. 17. At least one thread 38*b* is disposed on its inner surface for mating to a corresponding thread 39*b* on the container 11. Skirt 19*b* may be coupled to a tamper evident band 40*b* that includes a flange 41*b* and a frangible connection 42*b,* as described above with respect to the first embodiment.

Top cover 14*b* includes a base 48*b,* a tear band 50*b,* and a movable lid 52*b*. Preferably, these components of top cover 14*b* are formed from a single, continuous piece of plastic (as shown in the Figures), although the present invention encompasses forming top cover 14*b* in two or more pieces, forming all or portions of body 12*b* with top cover 14*b,* or forming portions of top cover 14*b* with body 12*b.* Top cover 14*b* forms at least three states or positions: a tamper—resistant position, a closed position, and an open position, as generally described above with respect to the first embodiment, and as described specifically herein.

Top cover 14*b* is disposed generally on top of body 12*b.* Base 48*b* is a ring that includes an outer wall 58, and inner wall 60, an upper portion 62, and a recess 64, as shown in FIG. 13. Outer wall 58 is concentric with and spaced apart from inner wall 60. Upper portion 62 is coupled between outer wall 58 and inner wall 60 to form a u-shape in cross section. Upper portion 62 may have a flat top surface, although other shapes may be employed according to aesthetic and functional considerations. An inner rim 66*b* is formed at the junction or the shared edge between upper portion 62 and inner wall 60.

Preferably, recess 64 is formed on the underside of base 48*b* to constitute an attachment feature that cooperates with bead 30. Specifically, recess 64 is annular and continuous around base 48*b* with a circular shape in cross section having an opening in its lower portion for receiving bead 30. The opening in recess 64 may have a radial width that is smaller than the diameter (or radial dimension) of the bead 30 to securely fasten or snap top cover 14*b* to body 12*b,* thereby making disassembly of top cover 14*b* from body 12*b* difficult without providing evidence of tampering.

Tear band 50*b* preferably is curved around the longitudinal axis C of the closure, or may be offset therefrom. Tear band 50*b* has an outer frangible connection 72*b* and an inner frangible connection 74*b.* The body of tear band 50*b* extends inwardly and inclines obliquely upwardly from base 48*b.* Thus, tear band 50*b* may smoothly form a portion of a frustum. Between connections 72*b* and 74*b,* tear band 50*b* has a flat profile on its upper surface to provide a smooth appearance to the outer, upper side of top cover 14*b.*

Outer connection 72*b* is formed between an outer edge of tear band 50*b* and inner rim 66*b* of base 48*b.* Inner connection 74*b* is formed between an outer edge of tear band 50*b* and the outer edge of lid 52*b.* Connections 72*b* and 74*b* are thin continuous membranes (relative to the thickness of tear band 50*b*) formed by weak or thin-walled portions of top cover 14*b* to enhance breaking when urged by a user. Like top cover 14*a* of the first embodiment, top cover 14*b* preferably is continuous over base 48*b,* connection 72*b,* tear band 50*b,* connection 74*b,* and lid 52*b,* except for a pair of slots 79*b* and 80*b* disposed near hinge 14*b,* which are described below. Thus, tear band connections 72*b* and 74*b* discourage liquids from passing through top cover 14*b.* The present invention encompasses connections 72*b* and 74*b* comprising slots inter-spaced between structural members (not shown), as described above.

Referring to FIG. 11, tear band 50*b* has a first end 77*b* and an opposing second end 78*b* that define the ends of each one of the connections 72*b* and 74*b.* Tear band 50*b* has an upwardly inclined protruding part at first end 77*b* that forms a tab 75*b* that may be gripped by a user to begin the process of detaching tear band 50*b.* Second end 78*b* may also have a tab (not shown). Tab 75*b* is an inclined portion of band 50*a* that has the same width as the tear band 50*a.* Tab 75*b* has a center that is substantially co-incident with the curved center of tear band 50*a.* Numerous configurations and geometries of tab 75*a* are encompassed by the present invention, as will be understood by persons familiar with plastic closure technology or with technology relating to detachable, plastic members such as tear bands.

Lid 52*b* includes a hinge 54*b,* a snap 56*b,* a cover 84*b,* and a plug 86*b.* Cover 84*b* has a top side that preferably is substantially planar and circular with a flattened side 91 proximate hinge 54*b.* The circular portion of cover 84*b* has a center that is coincident with centerline C, thereby centering top member 52*b* relative to orifice 26*b* and container 11. The outer perimeter of cover 84*b* is beveled on its top side to smoothly yield to inner connection 74*b.*

Flattened side 91 is defined by the chord formed by hinge 54*b,* and particularly by a first joint 96 and a panel 94, which are described below. A finger grip 92 is formed by a cut-out portion of cover 84*b* on the side opposing flattened side 91. Finger grip 92 may be formed by an undercut portion to provide a surface against which a user's finger may urge or pry to open closure 10*b.*

Plug 86*b* depends downwardly from the underside of cover 84*b.* Plug 86*b* preferably is generally cylindrical. Alternatively, plug 86*b* may have other shapes (not shown) such as an elliptical shape, although the shapes of plug 86*b* and orifice 26*b* should match to facilitate sealing therebetween. An outer circumferential surface of plug 86*b* forms a sealing surface 88*b,* which has an outer diameter that matches the inner diameter of spout wall 23*b* such that a seal is formed therebetween upon insertion of plug 86*b* into orifice 26*b.*

A circumferential bead 106, as best shown in FIG. 14, or similar protrusion is formed on the upper, outside surface 24*e* of spout wall 23*b.* A corresponding circumferential recess 108 is formed on a lower, outside surface of plug 86*b* such that bead 106 is inserted into recess 108, as shown for example in FIG. 13, upon plug 86*a* being fully seated into spout 22*b.* Bead 106 and recess 108 may provide an audible or sensible indication (that is, a snap) that plug 86*b* is fully seated, and may enhance sealing thereof. Wall inside surface 24*d* is otherwise shown as smooth in the Figures, although the present invention encompasses protrusions (such as steps, bosses, and the like, not shown) and other sealing surfaces that cooperate with a top cover extension or plug. Cover 84*b* preferably has an outer diameter larger than that of plug 86*b* to form a flange 90*b,* which extends around the circumference of plug 86*b.* Cover 84*b* may also have a cover skirt (not shown in the Figures illustrating the second embodiment) like that as described as skirt 87*a* with respect to the first embodiment.

Hinge 54*b* is disposed between tear band first end 77*b* and second end 78*b,* and hinge 54 preferably is separated from first ends 78*a* and 78*b* by slots 79*b* and 80*b,* respectively, as shown in FIG. 11. Preferably, tear band 50*b* circumscribes the majority of the circumference of lid 52*b,* and hinge 54*b* and slots 79*b* and 80*b* circumscribe or are disposed radially outside of the remaining circumference of lid 52*b.*

Hinge 54*b* includes a panel 94, a first joint 96, and second joint 98. Tear band 50*b* has a radial dimension that is equal or substantially equal to a radial dimension of hinge panel 94. Specifically, the outer radius of tear band 50*b,* measured from centerline C to outer connection 72*b,* is approximately equal to the radius of hinge 54*b,* measured from centerline C to the comer of hinge panel 64 where slot 79*b* or slot 80*b* meets first joint 96 (that is, the outermost joint).

Figure 15:
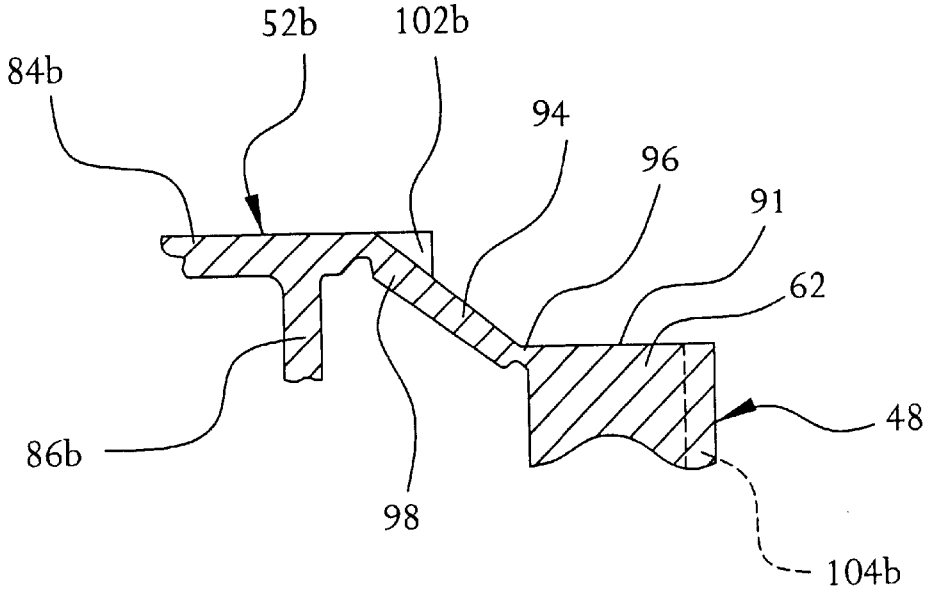
FIG. 15 is a cross sectional view of a portion of the top cover shown in FIG. 11 taken through the hinge area in the tamper resistant position.

As shown in FIG. 11 and FIG. 15, panel 94 is substantially flat and elongate (that is, is longer along its tangential axis than in a direction perpendicular to its tangential axis), and preferably is rectangular. The long sides of panel 94, which are oriented along its tangential axis) yield to and form a portion of joints 96 and 98. First joint 96 is formed between panel 94 and upper portion 62 of top cover base 48*b.* Upper portion 62 may have short chordal region 91 that extends to first joint 96, as shown in FIG. 11. Second joint 98 is formed between panel 94 and lid 52*b*. Joints 94 and 96 are formed by thin membrane—like portions of plastic (that is, thin relative to the thickness of base 48*b*, panel 94, and cover 84*b*) that are flexible, thereby forming a living hinge. The present invention encompasses other hinge configurations.

Snap 56*b* is formed on top cover 14*b* to releasably secure top cover 14*b* while it is in a fully open position. Snap 56*b* includes a protrusion, such as a snap boss 102*b*, disposed on one of base 48*b* and either cover 84*b* or hinge panel 94, and a mating recess, such as a snap recess 104*b*, disposed in the other of base 48*b* and either cover 84*b* or hinge panel 94*b*. As shown best in FIG. 15, snap boss 102*b* and recess 104*b* preferably are as generally described as with respect to the first embodiment. Lid 52*b* also includes crab claw seal 82*b* extending from the underside of cover 84*b*, similar to that described with respect to the first embodiment.

Preferably, orifice 26*b* has a diameter D1 that has the same relationship with container neck inside diameter D2 as described with respect to the first embodiment to provide beneficial pouring and drinking characteristics. Lid 52*b* is thus enabled to pivot such that movable cover 84*b*, plug 86*b*, and hinge 54*b* are spaced apart from orifice 26*b* and from the upper portions of closure 10*b* to enable a user's mouth to directly access orifice 26*b* by enabling the user's mouth to encircle or engage spout 22*b* and/or base 48*b*.

The operation of closure 10*b* with respect to the tamper resistant position and the closed position are similar to the operation described with respect to the first embodiment. Specifically, to open closure 10*b* from the tamper resistant position that is shown in FIG. 11, a user may grasp tear band 50*b* at tab 75*b* and pull generally upward to detach tear band connections 72*b* and 74*b* around the circumference of cover 84*b*. Upon fully detaching tear band 50*b*, closure 10*b* is in the closed position, as shown in FIG. 16. A user may discard tear band 50*b*, and place a finger into or under finger grip 92. Cover 84*b* may be urged upward opposite hinge 54*b* until plug 86*b* slides out from wall 23*b* and bead 106 disengages (that is, snaps above) from spout recess 108 to free lid 52*b*.

Both first and second hinge joints 96 and 98 enable cover 84*b* to pivot about base 48*b* while lid 52*b* is urged farther from the closed position toward the fully open position. Thus, panel 94 pivots about first joint 96 relative to base 48*b* and cover 84*b* pivots about second joint 98 relative to hinge 84*b* to enable moving lid 52*b* away from orifice 26*b*. The simultaneous pivoting about the dual joints 96 and 98 provides clearance for plug 86*b* to clear spout wall 23*b*. Cover 84*b* and base 48*b*, by at least partially covering spout 22*b*, promote sanitary conditions as described above with respect to spout 22*a*.

In the fully open position, shown in FIG. 17, hinge 54*b* is fully pivoted open such that hinge panel 94 is disposed well past a vertical position to a resting, nearly horizontal position. Hinge panel 94 has a radial width that is approximately equal to or larger than the radial width of base upper portion 62. Thus, in the fully open position, at least a portion of second joint 98 lies outside of the outer periphery of base 48*b* and/or skirt 19*b*. For example, a center of second joint 98 may be substantially tangential to the outermost periphery of base 48*b*. Further, snap boss 102*b* snaps into snap recess 104*b*.

Thus, cover 84*b* is pivotable to be spaced apart from orifice 26*b* and to be disposed completely outside of the periphery base 48*b* of closure 10*b*, thereby enabling access to spout 22*b* by a user's mouth. Specifically, it is preferred that all portions of cover 84*b* (that is, all parts of top cover 14*b* except hinge 54*b*) are disposed outside of a vertical, cylindrical geometric projection 100 (shown in FIG. 17 and analogously in FIG. 3C) of orifice 26*b*. Closure 10*b* may be re-positioned from the fully open position to the closed position by urging lid 52*b* toward the closed position (roughly counter-clockwise in FIG. 17) until snap boss 102*b* is freed from snap recess 104*b*, and until plug 86*b* inserts and is fully seated into orifice 26*b*.

The present invention has been described with respect to a pair of embodiments, although the present invention is not limited to the embodiments described. Rather, the invention broadly encompasses other embodiments having other features and configurations consistent with the claims. For example, the closures described in the written description are circular (that is, substantially cylindrical), although the present invention encompasses elliptical closures and/or containers. The present invention is described with respect to liquid products, although the invention may also be employed with pastes, creams, granules, powders and similar flowable products. Further, modifications to the embodiment described herein will be apparent to persons familiar with closure technology, injection and compression molding technology, and related technologies in light of the present disclosure.

We claim:

1. A closure for a container for use with a flowable product, comprising:

a closure body having a sidewall and a circumferential skirt downwardly depending from the sidewall, the sidewall defining an orifice for dispensing the product therethrough; and a top cover removably covering the orifice, including:

a circumferential base coupled to the closure body, wherein the closure body includes an annular recess formed around an outer periphery thereof and the top cover base includes an annular protrusion that is insertable into the annular recess to secure the top cover to the closure body;

a movable lid including a cover and a plug downwardly extending from the cover, the plug being removably insertable into the orifice to form a seal therewith, a detachable tear band removably coupling the lid to the base, and a hinge pivotally coupling the lid to the base, the tear band and the hinge disposed substantially around a perimeter of the cover;

the closure having a tamper-resistant position in which the tear band couples the lid to the base to prevent actuation of the lid, a closed position in which the tear band is detached from the top cover and the plug is sealably disposed within the closure body orifice, and an open position in which the lid is spaced apart from the orifice via pivoting about the hinge to enable dispensing of the liquid product.

2. The closure of claim 1 wherein the sidewall defines a spout.

3. The closure of claim 2 wherein the hinge includes a non-living hinge member coupled between the base and the cover member, the non-living hinge member being substantially continuously flexible to enable movement of the lid between a first position corresponding to the closed position and a second position corresponding to the open position.

4. The closure of claim 3 wherein the hinge includes an intermediate panel coupled between the non-living hinge member and the cover member, each one of the cover member, the base, and the intermediate panel being substantially rigid compared with the non-living hinge.

5. The closure of claim 3 wherein the cover member is pivotable about the non-living hinge by at least 180 degrees between the closed position and the open position, thereby enabling the top cover to pivot relative to the closure body to the open position in which the top cover is disposed completely outside of a vertical geometric projection of the orifice.

6. The closure of claim 5 wherein the cover member is pivotable about the non-living hinge by approximately 270 degrees, thereby enhancing access to the orifice to improve pour and drinking characteristics of the closure.

7. The closure of claim 3 wherein the cover member is entirely disposed lower than an uppermost portion of the spout in the open position.

8. The closure of claim 7 wherein the base is disposed lower than the uppermost portion of the spout in the open position, thereby enhancing a user's ability to drink directly from the closure.

9. The closure of claim 2 wherein the lid is openable from the closed position by a user's finger without directly touching the spout, thereby promoting cleanliness of the spout.

10. The closure of claim 1 wherein the hinge includes a hinge panel, a first joint pivotally coupled between the hinge panel and the base, and a second joint pivotally coupled between the hinge panel and the lid.

11. The closure of claim 10 wherein the hinge has a radial dimension that is at least as large as a radial dimension of the base, thereby enabling the top cover to pivot relative to the closure body to the open position in which the top cover is disposed completely outside of a vertical geometric projection of the orifice.

12. The closure of claim 10 wherein the hinge second joint is vertically higher than the hinge first joint to enable the top cover to pivot away from the orifice.

13. The closure of claim 10 wherein the hinge panel is elongate.

14. The closure of claim 10 wherein the first joint is a living hinge and the second joint is a living hinge.

15. The closure of claim 1 wherein the closure includes a snap releasably securing the lid to the closure body when the closure is in the open position.

16. The closure of claim 15 wherein the snap includes a protrusion on one of the lid and the base and a mating recess on the other of the lid and the base.

17. The closure of claim 16 wherein the snap protrusion comprises a snap boss extending radially outwardly from the cover when the closure is in the closed position, and the mating recess is formed in a periphery of the base.

18. The closure of claim 1 wherein each one of the closure body, the orifice, the plug, and the top cover base are substantially circular.

19. The closure of claim 1 wherein the closure body further comprises a top member encircling the orifice and the sidewall defines a spout, the plug being substantially circular to mate with an inside surface of spout to form the seal therebetween.

20. The closure of claim 19 wherein the spout is oriented substantially vertically and is substantially cylindrical, and the plug extends substantially vertically and is substantially cylindrical.

21. The closure of claim 19 wherein the cover forms a peripheral flange diametrally larger than the plug, the spout having a circumferential top rim that contacts the flange in the tamper-resistant position and in the closed position.

22. The closure of claim 1 wherein the tear band inclines obliquely upward from the base.

23. The closure of claim 22 wherein the tear band is substantially frustum-shaped around most of the circumference of the lid.

24. The closure of claim 22 wherein the tear band includes a tab for gripping by a user, whereby the closure is openable.

25. The closure of claim 24 wherein the tear band has an outer edge that is frangibly connected to the base and an inner edge that is frangibly connected to the cover.

26. The closure of claim 24 wherein the tab is a first tab and the tear band includes a second tab, the first tab and the second tab disposed on opposing ends of the tear band.

27. The closure of claim 24 wherein the tear band has a radial dimension that is equal to a radial dimension of the hinge.

28. The closure of claim 24 wherein the tear band tab protrudes above the cover to enhance gripping thereof.

29. The closure of claim 1 further comprising a tamper evident band frangibly coupled to the skirt at a lowermost edge thereof.

30. A closure for a container for use with a flowable product, comprising:

a closure body having a sidewall and a circumferential skirt downwardly depending from the sidewall, the sidewall defining an orifice for dispensing the product therethrough; and a top cover removably covering the orifice, including:

a circumferential base coupled to the closure body, a movable lid including a cover and a plug downwardly extending from the cover, the plug being removably insertable into the orifice to form a seal therewith, a detachable tear band removably coupling the lid to the base, and a hinge pivotally coupling the lid to the base, the tear band and the hinge disposed substantially around a perimeter of the cover; wherein the top cover base includes an inner vertical wall, an outer vertical wall that is concentric with the inner wall, and an upper portion that is coupled between the inner wall and the outer wall, the hinge being coupled to an inner rim formed by the inner wall and the upper portion;

the closure having a tamper-resistant position in which the tear band couples the lid to the base to prevent actuation of the lid, a closed position in which the tear band is detached from the top cover and the plug is sealably disposed within the closure body orifice, and an open position in which the lid is spaced apart from the orifice via pivoting about the hinge to enable dispensing of the liquid product.

31. The closure of claim 30 wherein the closure body has an upwardly extending ring lockably insertable between the inner wall and the outer wall of the top cover base to affix the top cover to the closure body.

* * * * *